US005881764A

United States Patent [19]

Ward

[11] Patent Number: 5,881,764

[45] Date of Patent: Mar. 16, 1999

[54] MULTI-LAYER FORMING FABRIC WITH STITCHING YARN PAIRS INTEGRATED INTO PAPERMAKING SURFACE

[75] Inventor: Kevin J. Ward, Nova Scotia, Canada

[73] Assignee: Weavexx Corporation, Wake Forest, N.C.

[21] Appl. No.: 905,489

[22] Filed: Aug. 4, 1997

[51] Int. Cl.[6] ..... D21F 1/00; D03D 13/00

[52] U.S. Cl. ..... 139/383 A; 162/903

[58] Field of Search ..... 139/383 A; 162/903

[56] References Cited

U.S. PATENT DOCUMENTS

| | | | |
|---|---|---|---|
| 3,325,909 | 6/1967 | Clark . | |
| 4,501,303 | 2/1985 | Osterberg . | |
| 4,605,585 | 8/1986 | Johansson . | |
| 4,739,803 | 4/1988 | Borel . | |
| 4,759,975 | 7/1988 | Sutherland et al. . | |
| 4,987,929 | 1/1991 | Wilson . | |
| 5,152,326 | 10/1992 | Vohringer . | |
| 5,238,536 | 8/1993 | Danby | 162/903 |
| 5,518,042 | 5/1996 | Wilson . | |
| 5,564,475 | 10/1996 | Wright . | |

FOREIGN PATENT DOCUMENTS

| | | |
|---|---|---|
| 0 224 276 | 12/1986 | European Pat. Off. . |
| 0 408 849 A2 | 11/1990 | European Pat. Off. . |
| 0 408 849 A3 | 11/1990 | European Pat. Off. . |
| 0 794 283 A1 | 9/1997 | European Pat. Off. . |
| 2 597 123 | 10/1987 | France . |
| 454 092 | 8/1927 | Germany . |
| WO 86/00099 | 3/1986 | WIPO . |

OTHER PUBLICATIONS

International Search Report for PCT Application No. PCT/US97/718627, Apr. 20, 1998.

*Primary Examiner*—Andy Falik
*Attorney, Agent, or Firm*—Myers, Bigel, Sibley & Sajovec

[57] ABSTRACT

A multi-layer papermaker's forming fabric utilizes stitching yarns in the papermaking surface and is formed of repeating units, each of which comprises: a set of top machine direction yarns; a set of bottom machine direction yarns; a set of bottom cross-machine direction yarns interwoven with the set of bottom machine direction yarns; and pairs of first and second stitching yarns extending in the cross machine direction. The first and second stitching yarns of each pair are interwoven with the top and bottom machine direction yarns such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first binding yarn is positioned below the top machine direction yarns. The first and second stitching yarns cross each other as they pass below a transitional top machine direction yarn. Each of the binding portions of the first and second stitching yarns passes below at least one of the bottom machine direction yarns. The fiber support portions of the stitching yarns and the top machine direction yarns form the papermaking surface.

26 Claims, 4 Drawing Sheets

101 102 103 104 105 106 107 108 109 110 111 112

3B
3B 182a
182b 183a
183b 184a
184b 185b
185a 186b
141 142 143 144 145 146 147 148 149 150 151 152 186a

MULTI-LAYER FORMING FABRIC WITH STITCHING YARN PAIRS INTEGRATED INTO PAPERMAKING SURFACE

FIELD OF THE INVENTION

The present invention relates generally to papermaking, and relates more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rolls covered with another fabric, typically referred to as a "press felt." Pressure from the rollers removes additional moisture from the web; the moisture removal is often enhanced by the presence of a "batt" layer of the press felt. The paper is then transferred to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are important considerations in papermaking, especially for the forming section of the papermaking machine, where the wet web is initially formed. Wire marking is particularly problematic in the formation of fine paper grades, as it affects a host of paper properties, such as sheet mark, porosity, see through, and pin holing. Wire marking is the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Regrettably, such finely woven forming fabrics often are delicate and lack dimensional stability in either or both of the machine and cross machine directions (particularly during operation), leading to a short service life for the fabric. In addition, a fine weave may adversely effect drainage properties of the fabric, thus rendering it less suitable as a forming fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed to include one fabric layer having a fine mesh, another fabric layer having a coarser mesh, and stitching yarns that bind the layers together. These fabrics, known as "triple layer" fabrics, are illustrated in U.S. Pat. No. 4,501,303 to Osterberg, U.S. Pat. No. 5,152,326 to Vohringer, and U.S. Pat. No. 5,437,315 to Ward.

Although these fabrics have performed successfully, they have some shortcomings that relate to the inclusion of the stitching yarns. In a typical triple layer forming fabric, one or more stitching yarns are positioned between some of the CMD yarns of the top and bottom layers and interwoven with the top and bottom MD yarns. In such a construction, portions of the stitching yarns form part of the papermaking surface of the fabric. As a result, the appearance of paper formed with the fabric can be affected (sometimes adversely) by the presence of the stitching yarns.

In addition, triple layer fabrics have proven to have problems with interlayer wear. As the fabric is used on a paper machine, the top and bottom layers tend to shift relative to one another, both in the machine direction and the cross machine direction, due to the tension imparted to the fabric by the rolls. This effect is exacerbated on paper machines, such as the so-called "high-wrap" machines, that include multiple rolls, including some which contact the top layer of the fabric. This shifting can cause the fabric to wear and decrease in thickness, which can adversely affect the drainage of the fabric and, accordingly, its performance in papermaking. In many instances, it is this interlayer wear, rather than the wear of the machine side surface of the fabric machine against the paper machine, that determines the longevity of the fabric.

Further, because the stitching yarns of a triple layer fabric have a different weave pattern than the top CMD yarns (i.e., they interweave with the bottom CMD yarns also, whereas the top CMD yarns do not), there can be differences in tension between the stitching yarns and the top CMD yarns. These differences can induce the fabric to distort out-of-plane, which can in turn reduce the quality of paper produced with the fabric.

Also, the stitching yarns of a triple layer fabric should be sufficiently strong and durable to bind the top and bottom layers and to resist the wear and abrasion conditions that the bottom layer experiences while in contact with the paper machine, yet should be delicate enough to produce high quality paper. This balance can be quite difficult to strike.

SUMMARY OF THE INVENTION

In view of the foregoing, it is an object of the present invention to provide a multi-layer forming fabric construction with little distortion in the top fabric layer.

It is also an object of the present invention to provide a multi-layer forming fabric construction that produces a high quality paper.

It is another object of the present invention to provide a multi-layer forming fabric construction that maintains the top and bottom layers in a tightly bound condition.

It is a further object of the present invention to provide a multi-layer forming fabric that addresses the problem of interlayer wear.

These and other objects are satisfied by the present invention, which relates to a multi-layer papermaker's forming fabric that utilizes stitching yarns in the papermaking surface. The fabric of the present invention is formed of repeating units, each of which comprises: a set of top machine direction yarns; a set of bottom machine direction yarns; a set of bottom cross-machine direction yarns interwoven with the set of bottom machine direction yarns; and pairs of first and second stitching yarns extending in the cross machine direction. The first and second stitching yarns of each pair are interwoven with the top and bottom machine direction yarns such that, as a fiber support portion of the first stitching yarn is interweaving with the top machine direction yarns, a binding portion of the second stitching yarn is positioned below the top machine direction yarns, and such that as a fiber support portion of the second stitching yarn is interweaving with the top machine direction yarns, a binding portion of the first binding yarn is positioned below the top machine direction yarns. The first and second stitching yarns cross each other as they pass below a transitional top machine direction yarn. Each of the binding portions of the first and second stitching yarns passes below at least one of the bottom machine direction yarns. The fiber support portions of the stitching yarns and the top machine direction yarns form the papermaking surface, which includes no more than 33 percent, and preferably is free of, cross machine direction yarns that fail to pass below at least one bottom machine direction yarn. In this configuration the stitching yarns both stitch the bottom layer to the top machine direction yarns and form a significant portion of the papermaking surface.

In a preferred embodiment, the fiber support portions of the stitching yarns form a plain weave papermaking surface with the top machine direction yarns. In another preferred embodiment, they form a 1×2 twill papermaking surface. In each instance, the density of stitching yarns tightly and reliably binds the layers of the fabric.

DETAILED DESCRIPTION OF THE PREFERRED EMBODIMENTS

The present invention will be described more particularly hereinafter with reference to the accompanying drawings. The invention is not intended to be limited to the illustrated embodiments; rather, these embodiments are intended to fully and completely disclose the invention to those skilled in this art.

Figure 1B:
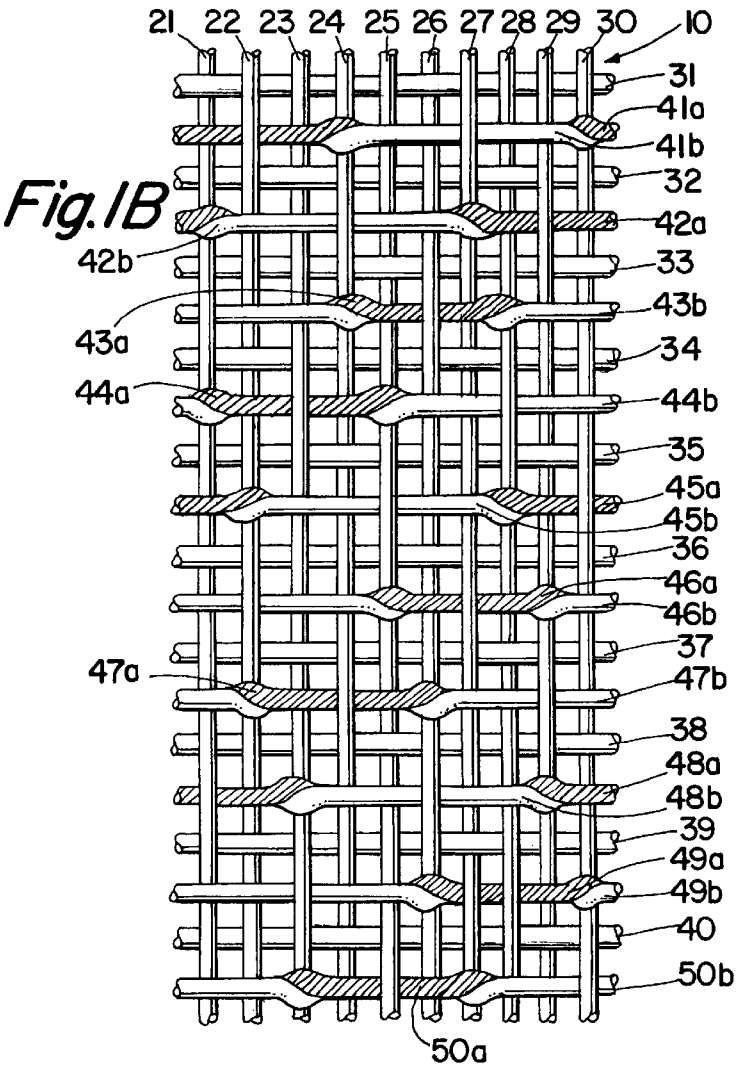
FIG. 1B is a top section view of the bottom surface of the fabric of FIG. 1.
Figure 1A:
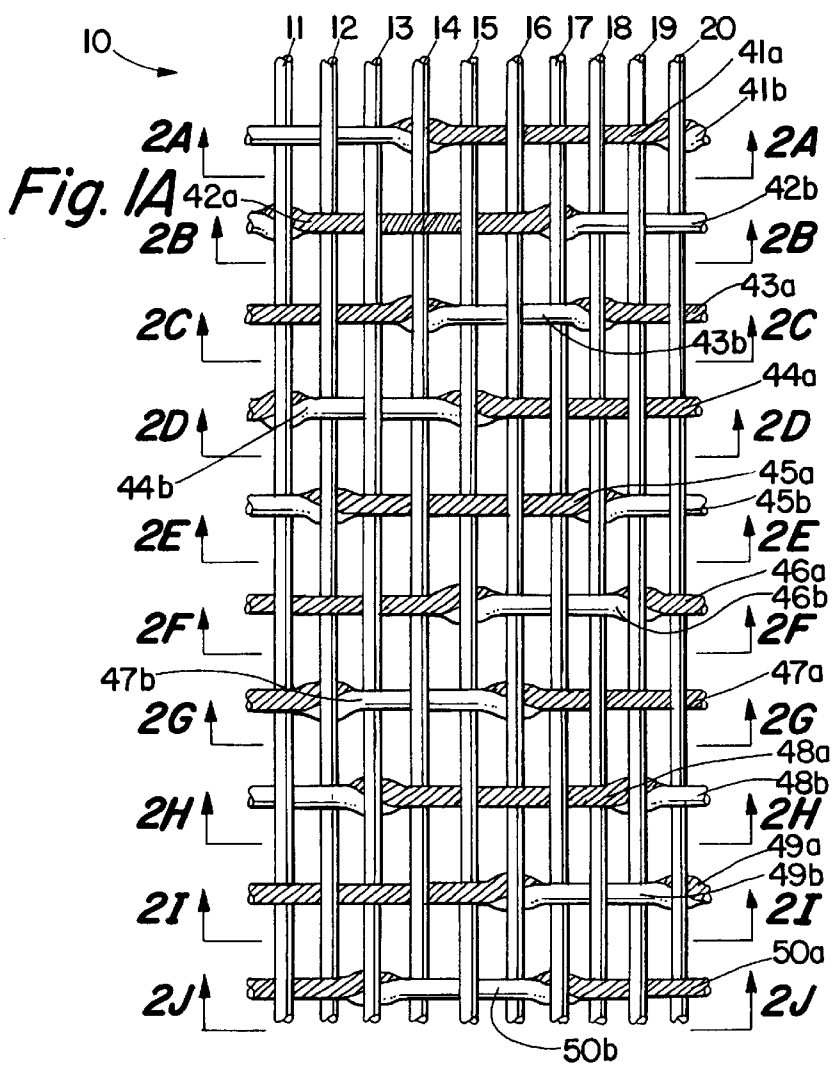
FIG. 1A is a top view of an embodiment of a 20 harness multi-layer forming fabric of the present invention having a plain weave top surface.

A 20 harness multi-layer forming fabric, generally designated at 10, is illustrated in FIGS. 1A and 1B, in which a single repeat unit of the fabric is shown. The repeat unit of the fabric 10 includes ten top MD yarns 11–20, ten bottom MD yarns 21–30, ten bottom CMD yarns 31–40, and stitching yarn pairs 41*a*, 41*b* through 50*a*, 50*b*.

Referring first to FIG. 1B, a repeat unit of the bottom layer of the fabric 10 is shown. The bottom MD yarns 21–30 are interwoven with the bottom CMD yarns 31–40 in a harness satin type pattern, with each bottom CMD yarn passing above one bottom MD yarn, below four bottom MD yarns, then repeating this "over 1/under 4" pattern. For example, bottom CMD yarn 31 passes above bottom MD yarn 21, below bottom MD yarns 22–25, above bottom MD yarn 26, and below bottom MD yarns 27 through 30. The other bottom CMD yarns follow the "over 1/under 4" weave pattern, but each is offset from its nearest bottom CMD yarn neighbors by two bottom MD yarns. Consequently, bottom CMD yarn 32 passes below bottom MD yarns 21 and 22, above bottom MD yarn 23, below bottom MD yarn 24 through 27, above bottom MD yarn 28, and below bottom MD yarns 29 and 30. Thus the "knuckle" formed by bottom MD yarn 23 as it passes below bottom CMD yarn 32 is offset from the "knuckle" formed by bottom MD yarn 21 as it passes over bottom CMD yarn 31 by two bottom MD yarns.

Referring now to FIG. 1A, the top layer of the fabric 10 is formed by the top MD yarns and by portions of the stitching yarn pairs. As can be seen in FIG. 1A, the stitching yarns and the top MD yarns combine to form a plain weave top surface. The interweaving of the stitching yarns and the top and bottom MD yarns can be understood by examination of FIGS. 1A and 2A through 2J.

Each of the stitching yarns of the repeat unit can be subdivided into two portions: a fiber support portion that interweaves with the top MD yarns, and a binding portion that interweaves with a bottom MD yarn. These are separated at "transitional" top MD yarns, below which one stitching yarn of a pair crosses the other stitching yarn of the pair. The stitching yarns of each pair are interwoven relative to one another such that the fiber support portion of one yarn of the pair is positioned above the binding portion of the other yarn of the pair. The fiber support portion of stitching yarns of each pair designated with an "a" (e.g., 41*a*, 42*a*, 43*a*) interweaves in an alternating fashion with five top MD yarns (alternately passing over three top MD yarns and under two top MD yarns), and the other stitching yarn of the pair (those designated with a "b") passes over two top MD yarns while passing below a top MD yarn positioned between those two MD yarns. In its fiber support portion, each stitching yarn passes over top MD yarns that fiber support portions of stitching yarns of adjacent pairs pass beneath, and passes below top MD yarns that fiber support portions of stitching yarns of adjacent pairs pass over. In this manner, the stitching yarns form a plain weave pattern with the top MD yarns (see FIG. 1A).

In its binding portion, each stitching yarn passes below one bottom MD yarn in the repeat unit. Each stitching yarn passes below the bottom MD yarn that is located between two knuckles formed by adjacent bottom MD yarns over the bottom CMD yarns that sandwich the stitching yarn. The combined binding portions of the stitching yarn pairs establish an "over 4/under 1" pattern on the bottom surface of the fabric 10 (see FIG. 1B).

Figure 2A:
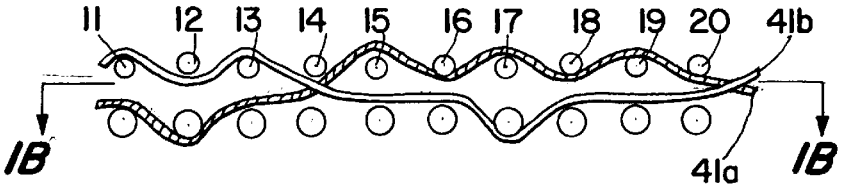
FIGS. 2A through 2J are section views of the stitching yarns of the fabric of FIGS. 1A and 1B.
Figure 2B:
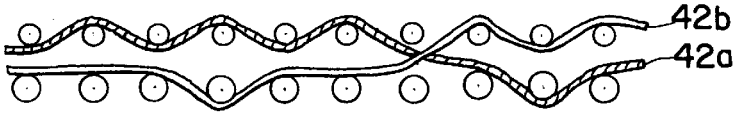
Figure 2C:
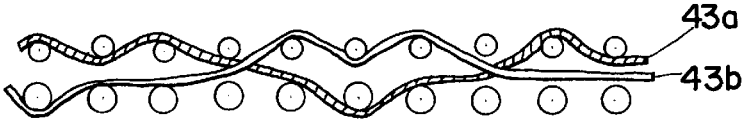
Figure 2D:
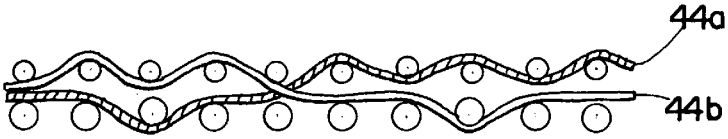
Figure 2E:
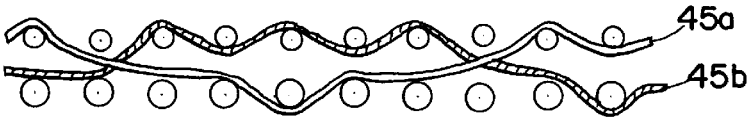
Figure 2F:
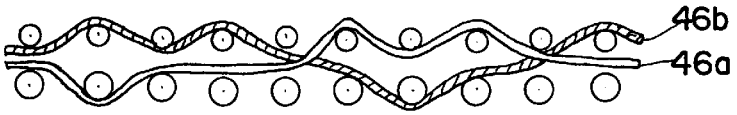
Figure 2G:
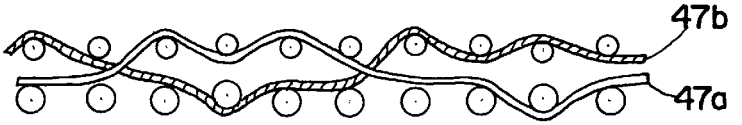
Figure 2H:
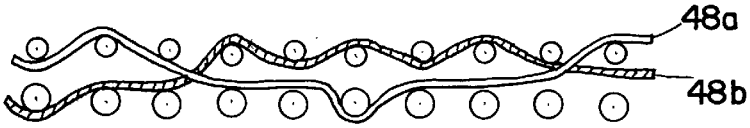
Figure 2I:
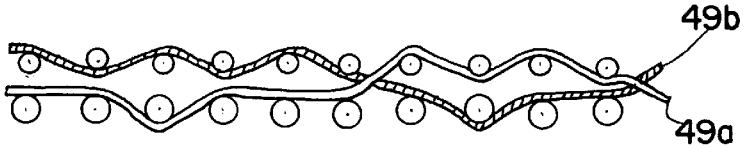
Figure 2J:
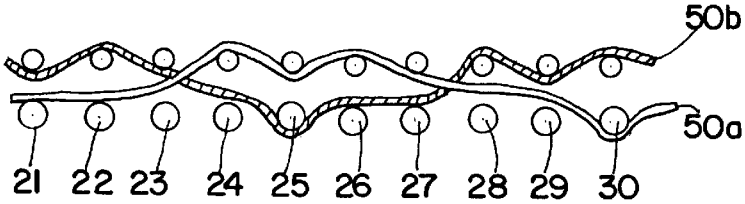

The weaving pattern of the stitching yarns is exemplified in FIG. 2I, which illustrates stitching yarns 49*a*, 49*b* interweaving with top and bottom MD yarns. In its fiber support portion, stitching yarn 49*a* passes over top MD yarns 11, 13 and 15, and below top MD yarns 12 and 14. It then passes below transitional top MD yarn 16 and above bottom MD yarn 26. In its binding portion, stitching yarn 49*a* passes below top MD yarns 17 through 19 while passing above bottom MD yarns 27 and 29 and below bottom MD yarn 28 to stitch the bottom layer of the fabric 10. Stitching yarn 49*a* then passes between top transitional MD yarn 20 and bottom MD yarn 30. FIG. 2I also illustrates that stitching yarn 49*b* is interwoven such that its binding portion is below that of stitching yarn 49*a*; stitching yarn 49*b* passes below top MD yarns 11 through 15 while passing above bottom MD yarns 21, 22, 24, 25 and below bottom MD yarn 23. In its fiber support portion, stitching yarn 49*b* passes above top MD yarn 17, below top MD yarn 18 and above top MD yarn 19, and below transitional top MD yarn 20 to continue the alternating weave established by stitching yarn 49*a*.

As can be seen in FIGS. 2A through 2H and 2J (which depict the interweaving patterns of the other stitching yarn pairs with the top and bottom MD yarns), the same pattern described hereinabove for the stitching yarns 49*a*, 49*b* relative to each other is followed by the other stitching yarn pairs.

Referring back to FIGS. 1A and 1B, adjacent pairs of stitching yarns are interwoven with the top and bottom MD yarns such that there is an offset of three MD yarns between such stitching yarn pairs. For example, stitching yarn 41*a* passes above top MD yarns 15, 17 and 19 and below bottom MD yarn 32. Stitching yarn 42*a* passes above top MD yarns 12, 14 and 16 and below bottom MD yarn 39. Thus, stitching yarn 42*a* is offset from stitching yarn 43*a* by three top and bottom MD yarns. This same three MD yarn offset is followed for the interweaving of the other stitching yarns.

It can also be seen in FIGS. 1A, 1B and 2A through 2J that the stitching yarn pairs are interwoven with the top and bottom MD yarns such that each "a" yarn (the stitching yarn that passes over three top MD yarns) is positioned between two "b" yarns (stitching yarns that pass over two top MD yarns), and each "b" yarn is positioned between two "a" yarns. This arrangement is demonstrated by examination of stitching yarn pairs 41*a*, 41*b*, 42*a*, 42*b*. As shown in FIGS. 1A and 1B, stitching yarn 41*b* is positioned between stitching yarns 41*a* and 42*a*. As seen in FIGS. 1A, 1B and 2B, stitching yarn 42*a* is positioned between stitching yarns 41*b* and 42*b*.

It has been discovered that this configuration is effective in improving the papermaking properties of the top surface of the fabric, particularly in regard to the transitional top MD yarns. When a transitional yarn passes over the stitching yarns of a pair to form a top surface knuckle, that knuckle tends to receive less upwardly-directed support from the stitching yarns at that location than other locations on the top MD yarn where it passes over a stitching yarn or top CMD yarn. As a result, that knuckle tends to be positioned slightly lower than the other top MD knuckles. As seen in FIG. 1A, the knuckles formed by the transitional top MD yarns define a series of broken diagonal lines; one example of this diagonal is formed by the knuckles formed by top MD yarn 14 over stitching yarn yarns 41*a*, 41*b* and 43*a*, 43*b*, top MD yarn 15 over stitching yarns 44*a*, 44*b* and 46*a*, 46*b*, top MD yarn 16 over stitching yarns 47*a*, 47*b* and 49*a*, 49*b*, and top MD yarn 17 over stitching yarns 50*a*, 50*b*. The broken diagonal line defined by these top MD yarn knuckles may have a slight depression because of the lesser upward support described above. Because the knuckles of this diagonal may all be positioned somewhat lower than the remaining top MD knuckles, paper formed on such a fabric can show this pattern, which can in turn affect images printed thereon. However, by including the stitching yarns in the alternating fashion of an "a" stitching yarn (which passes above three top MD yarns) followed by a "b" stitching yarn (which passes above two top MD yarns), and by offsetting the "a" and "b" yarns as indicated, the fiber support portions of stitching yarns of adjacent pairs that are positioned on one side of closely positioned top MD knuckles (e.g., the fiber support portions of stitching yarns 46*b*, 47*a*, which pass below the knuckles formed thereon by top MD yarns 15, 16) are adjacent to each other, while the fiber support portions of their paired yarns (i.e., stitching yarns 46*a*, 47*b*) that are positioned on the other side of these knuckles are separated from each other by the other stitching yarns of the pair. As a result, the diagonal formed by the transitional top MD knuckles is disturbed somewhat and is less distinctly defined. As such, paper formed on fabric 10 has a less distinct diagonal pattern due to these knuckles, and printing on the paper is improved.

Those skilled in this art will appreciate that the afore-described configuration is created in the fabric by weaving the stitching yarns into the top and bottom MD yarns so that the weaving of an "a" stitching yarn of a pair precedes the weaving of the "b" stitching yarn of the pair, then maintaining this sequence throughout the repeat unit. Although it is preferred that all of the stitching yarn pairs follow this pattern, some benefit can be obtained by varying the sequence so that only a smaller percentage (for example 25, 33, 40, or 50 percent) of the stitching yarn pairs follow this alternating sequence.

Those skilled in this art will also appreciate that other plain weave patterns in which the stitching yarns are divided differently into fiber support portions and binding portions can be constructed. For example, the fabric can include a top layer in which each stitching yarn of a pair passes over two, three, four or even more top MD yarns in its fiber support portion. The stitching yarns can pass over different numbers of top MD yarns, or can pass over the same number. Of course, appropriate adjustment of the positioning of the bottom knuckles in the binding portions of such stitching yarns should be made with changes to the stitching yarn pattern on the top surface.

Another embodiment of a multi-layer forming fabric of the present invention is illustrated in FIGS. 3A, 3B and 4A through 4F, in which a repeat unit of a multi-layer forming fabric, designated broadly at 100, is illustrated. The repeat unit includes twelve top MD yarns 101 through 112, twelve bottom MD yarns 141 through 152, six bottom CMD yarns 161 through 166, and twelve stitching yarns 181*a*, 181*b* through 186*a*, 186*b*.

Figure 3B:
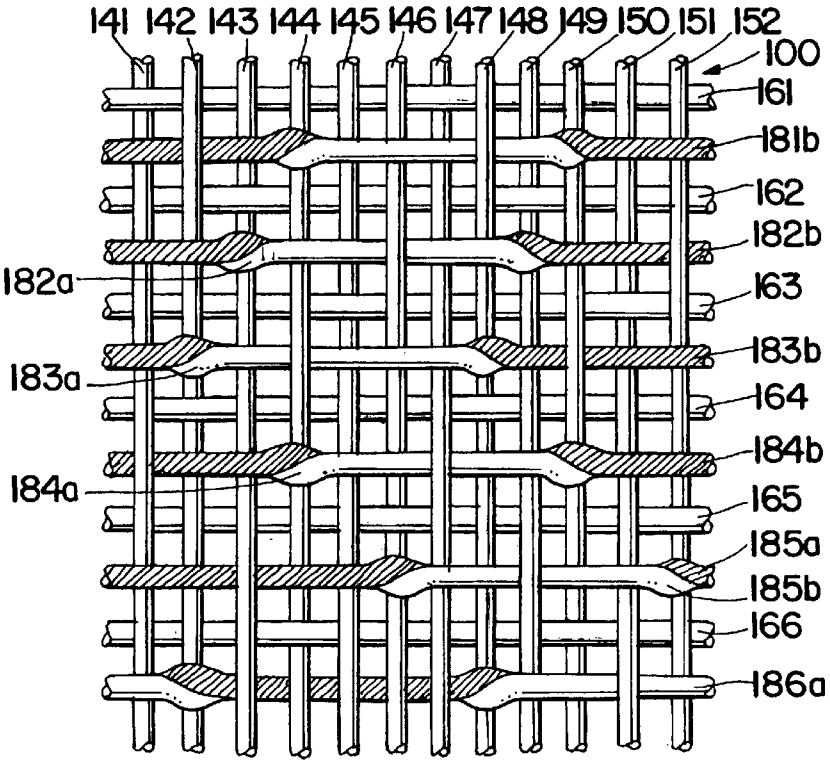
FIG. 3B is a top section view of the bottom surface of the fabric of FIG. 3A.

Referring first to FIG. 3B, the machine side surface of the fabric 100 formed by the bottom MD and CMD yarns takes the pattern of a "broken twill." Each bottom CMD yarn has an "over 1/under 5" repeat pattern with the bottom MD yarns. For example, bottom CMD yarn 161 passes over bottom MD yarn 141, under bottom MD yarns 142 through 146, over bottom MD yarn 147, and under bottom MD yarns 148 through 152. This "over 1/under 5" pattern is repeated by the remaining CMD yarns. However, the bottom side knuckles formed by the bottom MD yarns as they pass below the bottom CMD yarns are arranged in a broken twill pattern, with the bottom side knuckles being formed by bottom MD yarns 141, 143, 145, 142, 146, 144 on bottom CMD yarns 161 through 166, respectively, and by bottom MD yarns 147, 149, 151, 148, 152, 150 on bottom CMD yarns 161 through 166, respectively. As can be seen in FIG. 3B, these knuckles fail to form a clear diagonal as is characteristic of twill fabrics, but instead form a "broken twill" pattern.

Figure 3A:
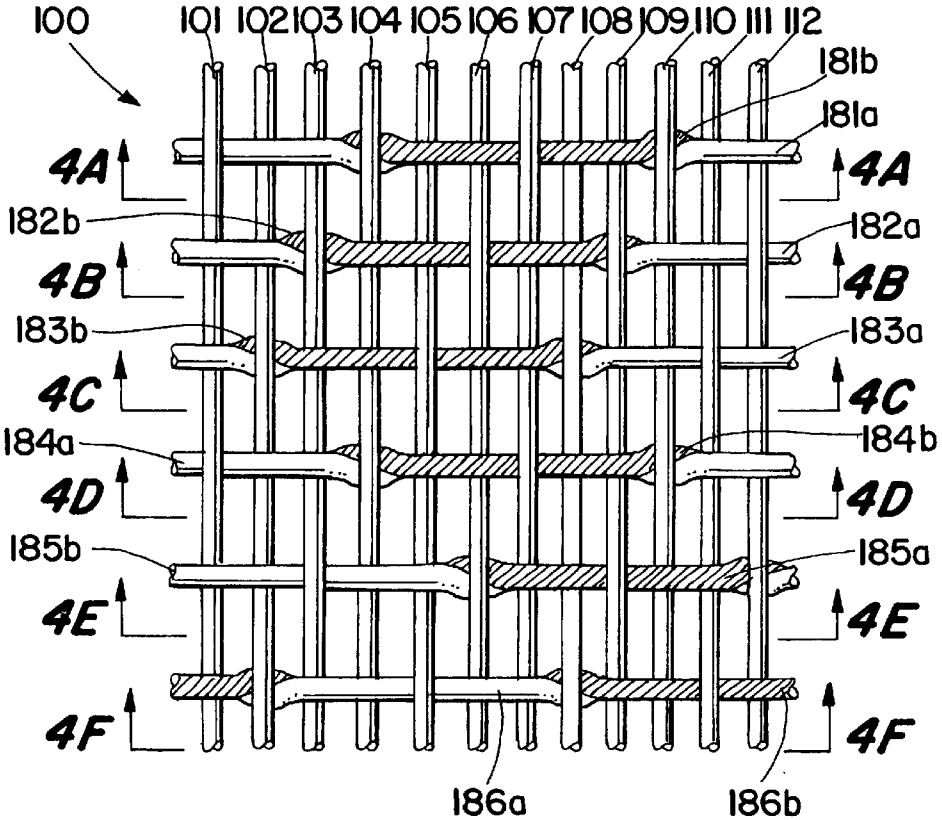
FIG. 3A is a top view of a 24 harness multi-layer forming fabric of the present invention having a 1×2 twill top surface.

As shown in FIG. 3A, the top surface of the fabric 100 has a 1×2 twill pattern formed by the top MD yarns and portions of the stitching yarns. As with the fabric 10 described earlier, each stitching yarn has a fiber support portion and a binding portion; these are divided by transitional top machine direction yarns, below which stitching yarns of a pair cross each other. The fiber support portion of each stitching yarn follows an "over 2/under 1/over 2" pattern as it interweaves with the top MD yarns. In its binding portion, each stitching yarn passes between top and bottom MD yarns with the exception of passing below one bottom MD yarn. The bottom MD yarn that is stitched is located either 1 or 2 MD yarns away from the transitional MD yarns that separate the fiber support and binding portions of each stitching yarn.

Figures 4A, 4B, 4C, 4D, 4E, 4F:
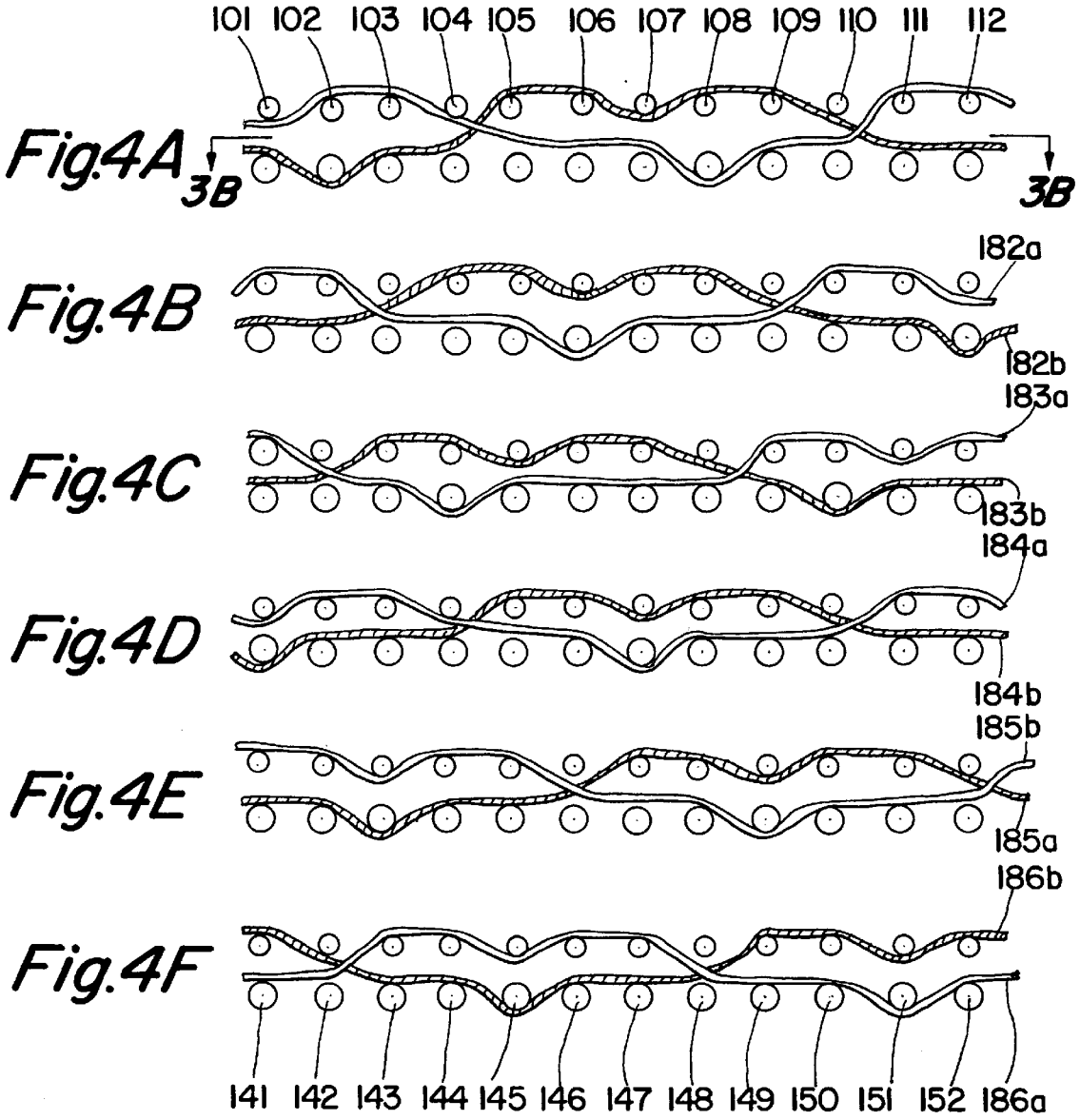
FIGS. 4A through 4F are section views of the stitching yarns of the fabric of FIGS. 3A and 3B.

This pattern is exemplified by stitching yarn 185*a*, the stitching pattern of which is illustrated in FIG. 4E. Stitching yarn 185*a* passes over top MD yarns 101 and 102, under top MD yarn 103, and over top MD yarns 104, 105 before passing below transitional top MD yarn 106. In its binding portion, stitching yarn 185*a* passes above bottom MD yarns 147 and 148, below bottom MD yarn 149 and above bottom MD yarns 148, 149 before passing below transitional top MD yarn 112.

Pairs of stitching yarns are interwoven with the top MD yarns relative to one another such that their fiber support portions and the top MD yarns form a 1×2 twill pattern. Referring again to FIG. 4E, and as described above, stitching yarn 185*a* passes above top MD yarns 101, 102 under top MD yarn 103, and over top MD yarns 104, 105. Both stitching yarns 185*a*, 185*b* pass below transitional top MD yarn 106, after which the fiber support portion of stitching yarn 185*b* continues the over 2/under 1 twill pattern first established by stitching yarn 185*a*. In doing so, stitching yarn 185*b* passes above top MD yarns 107, 108, below top MD yarn 109 and above top MD yarns 110, 111 before passing below transitional top MD yarn 112.

FIG. 5A demonstrates that the stitching yarns are interwoven with the top MD yarns such that a "over 2" segment of each fiber support portion is offset by one top MD yarn from the "over 2" segments of stitching yarns of adjacent stitching yarn pairs that flank that stitching yarn. For example, stitching yarn 181*a* passes over top MD yarns 102 and 103. The nearest top CMD yarns, which are 121 and 122, pass over top MD yarns 101, 102 and 103, 104 respectively. Thus, the distinctive diagonal of a 1×2 twill is formed by the fiber support portions of the stitching yarns.

FIG. 3B also illustrates how the stitching yarns are stitched into the bottom MD yarns. It can be seen in FIG. 3B that the knuckle formed by each stitching yarn as it passes below a bottom MD yarn is positioned such that, in one direction, two bottom CMD yarns reside between the stitching yarn knuckle and the knuckle formed by that bottom MD yarn over a bottom CMD yarn, and in the opposite direction, three bottom CMD yarns reside between the stitching yarn knuckle and the next knuckle formed by that bottom MD yarn over a CMD yarn. For example, stitching yarn 184*a* forms a knuckle as it passes under bottom MD yarn 141. The bottom MD yarn 141 forms a knuckle as it passes under bottom CMD yarn 161, which is separated from the knuckle formed by stitching yarn 184*a* by three bottom CMD yarns (162, 163, 164). Continuing with the pattern in the other direction, bottom CMD yarns 165 and 166 are positioned between the knuckle formed by stitching yarn 184*a* and the knuckle that would be formed by bottom MD yarn 141 under the next bottom CMD yarn after bottom CMD yarn 166 (which would have the same weave pattern as bottom CMD yarn 161). Thus, the stitching yarn knuckle of stitching yarn 184*a* is separated from bottom MD yarn knuckles by three bottom CMD yarns in one direction and by two CMD yarns in the other direction.

Those skilled in this art will further appreciate that fabrics of the present invention can be constructed with other twill patterns in the top layer. For example, a fabric can have a 1×3 or 1×4 twill top layer. Any of these twill patterns can be a conventional twill, such as that of the fabric 100, or can take a broken twill pattern, such as that of the surface of a conventional 4 or 5 harness satin single layer fabric. Fabrics can also be constructed in which fiber support portions of stitching yarn pairs pass over different numbers of top MD yarns. In each instance, the skilled artisan should understand the appropriate modifications to the binding portions of the stitching yarns to accommodate differences in the fiber support portions.

Those skilled in this art will recognize that, although the plain weave and twill fabrics illustrated and described in detail herein are preferred, other fabric weaves, such as other twill weaves and satins, that employ pairs of stitching yarns integrated into the papermaking surface of a fabric with the top MD yarns can also be made. It is also contemplated that, although the fabrics 10 and 100 illustratively and preferably are free of CMD yarns that fail to pass below at least one bottom MD yarn, fabrics of the present invention can also include some CMD yarns that interweave only with top MD yarns. These should comprise no more than 33 percent of the top surface of the fabric (i.e., there should be no more than one of these CMD yarns for every two pairs of stitching yarns), and preferably should comprise no more than 25 or 20 percent of the top surface, with a top surface being free of such CMD yarns being most preferred.

Any number of configurations of the bottom layer in which stitching yarn pairs stitch the bottom MD yarns can be used. In addition, although the illustrated fabrics have equal numbers of top and bottom CMD yarns and stitching yarn pairs, this need not be the case for the present invention; other ratios, such as two stitching yarn pairs for each bottom CMD yarn, can also be employed.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of cotton, wool, polypropylene, polyester, aramid, nylon, or the like. The skilled artisan should select a yarn material according to the particular application of the final fabric.

Regarding yarn dimensions, the particular size of the yarns is typically governed by the size and spacing of the papermaking surface. Generally, the diameter of the top MD yarns is about equal to or smaller than the diameter of the bottom MD yarns, and the diameter of the bottom CMD yarns is somewhat larger than that of the bottom MD yarns. In a typical fabric, the diameter of the top MD yarns is between about 0.11 and 0.15 mm, the diameter of the bottom CMD yarns is between about 0.20 and 0.40 mm, and the diameter of the bottom MD yarns is between about 0.17 and 0.25 mm. The diameter of the stitching yarns is typically between about 0.11 and 0.17 mm.

Yarns may also vary advantageously in modulus of elasticity. For example, stitching yarns that interweave with a fewer number of top MD yarns than its paired stitching yarn (such as the "b" yarns of fabric 10) may have a higher modulus of elasticity (typically between about 10 and 50 percent higher) than its paired stitching yarn.

As the foregoing discussion demonstrates, the fabrics of the present invention address problems encountered with prior art triple layer forming fabrics. The fabrics of the present invention utilize the stitching yarns as the top surface of the fabric, whether it be a plain weave, a twill, a satin, or other pattern, and therefore avoid the marring of the papermaking surface that can accompany the inclusion of stitching yarns that comprise less of the papermaking surface. The integration of the fabric attributable to the stitching yarns also greatly reduces (if not eliminating entirely) interlayer wear. In addition, because the stitching yarns comprise the papermaking surface, the differences in tension between top CMD yarns and stitching yarns of prior art fabrics that can distort the papermaking surface are not present in the fabrics of the present invention. The density of the stitching yarns also provides a more complete binding of the top and bottom layers of the fabric, which can provide the designer with a wider variety of yarn choices as the balance of paper forming properties and durability and wear.

The foregoing embodiments are illustrative of the present invention, and are not to be construed as limiting thereof. The invention is defined by the following claims, with equivalents of the claims to be included therein.

That which is claimed:

1. A papermaker's fabric, comprising top machine direction yarns, bottom machine direction yarns, bottom cross machine direction yarns, and sets of first and second stitching cross-machine direction yarns, said fabric being formed in a plurality of repeating units, each of said repeating units comprising:

a set of top machine direction yarns;

a set of bottom machine direction yarns;

a set of bottom cross-machine direction yarns interwoven with said set of bottom machine direction yarns; and pairs of first and second stitching yarn extending in the cross machine direction, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first binding yarn is positioned below said top machine direction yarns, and such that said first and second yarns cross each other as they pass below a transitional top machine direction yarn, and such that each of said binding portions of said first and second stitching yarns passes below at least one of said bottom machine direction yarns;

said fiber support portions of said stitching yarns and said top machine direction yarns defining a papermaking surface, said papermaking surface including no more than 33 percent of cross-machine direction yarns that fail to pass under at least one bottom machine direction yarn.

2. The papermaker's fabric defined in claim 1, wherein fiber support portions of first alternate pairs of stitching yarns pass over a first group of alternate top machine direction yarns and under a second group of alternate top machine direction yarns, and fiber support portions of second alternate pairs of stitching yarns pass over said second group of top machine direction yarns and under said first group of alternate top machine direction yarns, said fiber support portions of said first and second alternate pairs of stitching yarns, said first group of alternate top machine direction yarns, and said second group of alternate machine direction yarns form a plain weave top surface of said fabric.

3. The papermaker's fabric defined in claim 2, wherein said fiber support portions of said first stitching yarns pass over a first number of said machine direction yarns, said fiber support portions of second stitching yarns passes over a second number of said machine direction yarns, and said first number differs from said second number.

4. The papermaker's fabric defined in claim 3, wherein said first number is larger than said second number, and wherein said second stitching yarns have a higher modulus of elasticity than said first stitching yarn.

5. The papermaker's fabric defined in claim 3, wherein said first number is three, and said second number is two.

6. The papermaker's fabric defined in claim 1, wherein said first and second stitching yarns are of a smaller diameter than said top machine direction yarns.

7. The papermaker's fabric defined in claim 1, wherein each of said binding portions of said first and second stitching yarns passes beneath only one of said bottom machine direction yarns.

8. The papermaker's fabric defined in claim 1, wherein said repeat unit includes 10 top machine direction yarns and 10 bottom machine direction yarns.

9. The papermaker's fabric defined in claim 1, wherein said top machine direction yarns and said fiber support portions of said first and second stitching yarns are interwoven in a repeating pattern such that each of said fiber support portions passes over a first pair of adjacent top machine direction yarns, under a third top machine direction yarn adjacent to said first pair, and over a second pair of top machine direction yarns positioned adjacent said third top machine direction yarn, and wherein fiber support portions of adjacent stitching yarns pass over top machine direction yarn pairs that are offset by one top machine direction yarns such that said top machine direction yarns and said fiber support portions of said first and second stitching yarns form a 1×2 twill pattern.

10. The papermaker's fabric defined in claim 1, wherein said papermaking surface is free of cross machine direction yarns that fail to pass below at least one bottom machine direction yarn.

11. The papermaker's fabric defined in claim 1, wherein said stitching yarns are interwoven with said top and bottom machine direction yarns such that adjacent pairs of stitching yarns cross beneath transitional top machine direction yarns that are offset by three top machine direction yarns.

12. The papermaker's fabric defined in claim 1, wherein between 25 and 50 percent of said first and second stitching yarns are alternately interwoven with said top machine direction yarns.

13. A papermaker's fabric comprising top machine direction yarns, bottom machine direction yarns, bottom cross machine direction yarns, and sets of first and second stitching cross-machine direction yarns, said fabric being formed in a plurality of repeating units, each of said repeating units comprising:

a set of top machine direction yarns;

a set of bottom machine direction yarns;

a set of bottom cross-machine direction yarns interwoven with said set of bottom machine direction yarns; and pairs of first and second stitching yarn extending in the cross machine direction, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first binding yarn is positioned below said top machine direction yarns, and such that said first and second yarns cross each other as they pass below a transitional top machine direction yarn, and such that each of said binding portions of said first and second stitching yarns passes below at least one of said bottom machine direction yarns, and such that between 25 and 50 percent of said stitching yarns are alternately interwoven with said top machine direction yarns;

said fiber support portions of said stitching yarns and said top machine direction yarns defining a papermaking surface, said papermaking surface including no more than 33 percent of cross machine direction yarns that fail to pass under at least one bottom machine direction yarn.

14. The papermaker's fabric defined in claim 13, wherein fiber support portions of first alternate pairs of stitching yarns pass over a first group of alternate top machine direction yarns and under a second group of alternate top machine direction yarns, and fiber support portions of second alternate pairs of stitching yarns pass over said second group of top machine direction yarns and under said first group of alternate top machine direction yarns, said fiber support portions of said first and second alternate pairs of stitching yarns, said first group of alternate top machine direction yarns, and said second group of alternate machine direction yarns form a plain weave top surface of said fabric.

15. The papermaker's fabric defined in claim 14, wherein said fiber support portions of said first stitching yarn pass over a first number of said machine direction yarns, said fiber support portions of second stitching yarns passes over a second number of said machine direction yarns, and said first number differs from said second number.

16. The papermaker's fabric defined in claim 15, wherein said first number is larger than said second number, and wherein said second stitching yarns have a higher modulus of elasticity than said first stitching yarn.

17. The papermaker's fabric defined in claim 15, wherein said first number is three, and said second number is two.

18. The papermaker's fabric defined in claim 13, wherein said first and second stitching yarns are of a smaller diameter than said top machine direction yarns.

19. The papermaker's fabric defined in claim 13, wherein each of said binding portions of said first and second stitching yarns passes beneath only one of said bottom machine direction yarns.

20. The papermaker's fabric defined in claim 13, wherein said repeat unit includes 10 top machine direction yarns and 10 bottom machine direction yarns.

21. The papermaker's fabric defined in claim 13, wherein said stitching yarns are interwoven with said top and bottom machine direction yarns such that adjacent pairs of stitching yarns cross beneath transitional top machine direction yarns that are offset by three top machine direction yarns.

22. The papermaker's fabric defined in claim 13, wherein said papermaking surface is free of cross machine direction yarns that fail to pass below at least one bottom machine direction yarn.

23. A method of making paper, comprising the steps of:

(a) providing a papermaker's fabric, said fabric comprising top machine direction yarns, bottom machine direction yarns, bottom cross machine direction yarns, and sets of first and second stitching cross-machine direction yarns, said fabric being formed in a plurality of repeating units, each of said repeating units comprising:

a set of top machine direction yarns;

a set of bottom machine direction yarns;

a set of bottom cross-machine direction yarns interwoven with said set of bottom machine direction yarns; and pairs of first and second stitching yarn extending in the cross machine direction, said first and second stitching yarns of each pair being interwoven with said top and bottom machine direction yarns such that, as a fiber support portion of said first stitching yarn is interweaving with said top machine direction yarns, a binding portion of said second stitching yarn is positioned below said top machine direction yarns, and such that as a fiber support portion of said second stitching yarn is interweaving with said top machine direction yarns, a binding portion of said first binding yarn is positioned below said top machine direction yarns, and such that said first and second yarns cross each other as they pass below a transitional top machine direction yarn, and such that each of said binding portions of said first and second stitching yarns passes below at least one of said bottom machine direction yarns;

said fiber support portions of said stitching yarns and said top machine direction yarns defining a papermaking surface, said papermaking surface including no more than 33 percent of cross machine direction yarns that fail to pass under at least one bottom machine direction yarn;

(b) applying paper stock to said fabric; and (c) removing moisture from said paper stock.

24. The method defined in claim 23, wherein fiber support portions of first alternate pairs of stitching yarns pass over a first group of alternate top machine direction yarns and under a second group of alternate top machine direction yarns, and fiber support portions of second alternate pairs of stitching yarns pass over said second group of top machine direction yarns and under said first group of alternate top machine direction yarns, said fiber support portions of said first and second alternate pairs of stitching yarns, said first group of alternate top machine direction yarns, and said second group of alternate machine direction yarns form a plain weave top surface of said fabric.

25. The method defined in claim 23, wherein said top machine direction yarns and said fiber support portions of said first and second stitching yarns are interwoven in a repeating pattern such that each of said fiber support portions passes over a first pair of adjacent top machine direction yarns, under a third top machine direction yarn adjacent to said first pair, and over a second pair of top machine direction yarns positioned adjacent said third top machine direction yarn, and wherein fiber support portions of adjacent stitching yarns pass over top machine direction yarn pairs that are offset by one top machine direction yarns such that said top machine direction yarns and said fiber support portions of said first and second stitching yarns form a 1×2 twill pattern.

26. The papermaker's fabric defined in claim 23, wherein said papermaking surface is free of cross machine direction yarns that fail to pass below at least one bottom machine direction yarn.

* * * * *

UNITED STATES PATENT AND TRADEMARK OFFICE

CERTIFICATE OF CORRECTION

| | | |
|---|---|---|
| PATENT NO. | : | 5,881,764 |
| DATED | : | March 16, 1999 |
| INVENTOR(S) | : | Kevin J. Ward |

It is certified that error appears in the above-identified patent and that said Letters Patent is hereby corrected as shown below:

Title Page, item [22] and col. 1, filing date should read as follows:
--August 1, 1997--
--
Title Page, item Other Publications, and col. 2, please correct "US97/718627 to read –US97/18627--.

Signed and Sealed this

Eighth Day of February, 2000

*Attest:*

Q. TODD DICKINSON

*Attesting Officer*

*Commissioner of Patents and Trademarks*